US008279208B2

(12) United States Patent
Shimodaira

(10) Patent No.: US 8,279,208 B2
(45) Date of Patent: Oct. 2, 2012

(54) DRIVING CIRCUIT OF MATRIX DEVICE, MATRIX DEVICE, IMAGE DISPLAY DEVICE, ELECTROPHORETIC DISPLAY DEVICE, AND ELECTRONIC APPARATUS

(75) Inventor: Yasuhiro Shimodaira, Munich (DE)

(73) Assignee: Seiko Epson Corporation, Tokyo (JP)

( * ) Notice: Subject to any disclaimer, the term of this patent is extended or adjusted under 35 U.S.C. 154(b) by 415 days.

(21) Appl. No.: 12/552,414

(22) Filed: Sep. 2, 2009

(65) Prior Publication Data

US 2010/0079422 A1 Apr. 1, 2010

(30) Foreign Application Priority Data

Sep. 30, 2008 (JP) ..... 2008-253422

(51) Int. Cl.
*G06F 3/038* (2006.01)
*G09G 5/00* (2006.01)

(52) U.S. Cl. ..... 345/205; 345/100

(58) Field of Classification Search ..... 345/100, 345/107, 205

See application file for complete search history.

(56) References Cited

U.S. PATENT DOCUMENTS

| | | | | |
|---|---|---|---|---|
| 7,542,024 | B2 * | 6/2009 | Koyama | 345/107 |
| 2004/0174347 | A1 * | 9/2004 | Sun et al. | 345/204 |
| 2005/0264518 | A1 * | 12/2005 | Nojiri et al. | 345/103 |
| 2007/0216631 | A1 * | 9/2007 | Nojiri | 345/100 |

FOREIGN PATENT DOCUMENTS

| | | | |
|---|---|---|---|
| JP | 2006-119409 | A | 5/2006 |
| JP | 2008-268853 | A | 11/2008 |

* cited by examiner

*Primary Examiner* — Chanh Nguyen
*Assistant Examiner* — Kwang-Su Yang
(74) *Attorney, Agent, or Firm* — AdvantEdge Law Group, LLC

(57) ABSTRACT

A driving circuit is provided which is applied to a matrix device having a plurality of functional elements arranged in a matrix, which is connected to the functional elements via data lines, and which has a plurality of blocks. The driving circuit includes a shift register which has a plurality of register sections, each of the register sections being corresponding to one of the plurality of blocks; a data signal line; a first data latch circuit connected to an output terminal of the shift register and the data signal line; and a second data latch circuit connected to the output terminal of the shift register and an output terminal of the first data latch circuit, and connected to the data line directly or via another circuit. The first and second data latch circuits are respectively divided into multistage operation units. Each of the operation units is corresponding to the one data line or the plurality of data lines and is corresponding to one of the plurality of blocks. An output terminal of the shift register belonging to a block B is connected to the operation unit of the first data latch circuit belonging to the block B, the output terminal of the shift register belonging to a block A is connected to the operation unit of the second data latch circuit belonging to the block B, and each of the block A and block B is one of the plurality of blocks.

9 Claims, 13 Drawing Sheets

DRIVING CIRCUIT OF MATRIX DEVICE, MATRIX DEVICE, IMAGE DISPLAY DEVICE, ELECTROPHORETIC DISPLAY DEVICE, AND ELECTRONIC APPARATUS

BACKGROUND

1. Technical Field

The present invention is related to a driving circuit of a matrix device, a matrix device, an image display device, an electrophoretic display device, and an electronic apparatus.

2. Related Art

Matrix devices, which include functional elements arranged in a matrix, and which sequentially select these functional elements to fulfill a predetermined function, are used in various devices. For example, they are used in image display devices such as electrophoretic display devices, liquid crystal displays, EL display devices and the like, or various devices such as capacitance detection devices which are components of finger print sensors and the like.

The matrix device is provided with a driving circuit connected to the functional elements via lines. For example, the image display device is provided with a scan line driving circuit which inputs selection signals to the pixels used as the functional elements, and a data line driving circuit which inputs image signals to the pixels. Further, in the data line driving circuit, a plurality of systems (a dot-sequential system, a line-sequential system, a block sequential system and the like) are also adopted according to usage.

Among the plurality of systems of the data line driving circuit, the line-sequential system is a driving system suitable for an image display device since it can secure long signal input time as compared with other systems (see JP-A-2006-119409). Here, FIG. 12 is a view showing a portion of the line-sequential system of the data line driving circuit. A data line driving circuit 300 includes a shift register 310, a first data latch circuit 311, a second data latch circuit 312, and a data buffer circuit 313.

In the data line driving circuit 300, latch circuits of the first data latch circuit 311 are activated by selection signals SEL[0] to SEL[2] sequentially output from the shift register 310 and image signals D1 to D3, which are supplied via corresponding data signal lines 315, are written to each of the latch circuits. After the writing to the first data latch circuit 311 is finished, a latch activation signal LAT is input to the second data latch circuit 312 via a latch control line 317. Herewith, the output (image signal) of the first data latch circuit 311 is transferred to the second data latch circuit 312. The image signals output from the second data latch circuit 312 are then output all at once with respect to all data lines 68 via a data buffer circuit 313. In accordance with the above-described operation, the image signals are input to the pixels 40 of the display section 5.

However, the image display device including the line-sequential system of the data line driving circuit is constituted so that if the latch activation signal LAT is input, all the latch circuits constituting the second data latch circuit 312 operate all at once, and the image signals are output all at once to all data lines 68. At this time, since a large current is caused to instantaneously flow in the data buffer circuit 313, a voltage drop in the power supply occurs. When the power supply of the image display device then suffers from a low performance of the power supply, such as a button battery or the like, there is a danger that a case may occur where power is cut off one time and restored, thereby initializing the device.

SUMMARY

An advantage of some aspects of the invention is to provide a driving circuit of a matrix device capable of preventing large and instantaneous power consumption from occurring and capable of stably operating, and to provide a matrix device, an image display device, and an electrophoretic display device including such a driving circuit.

According to a first aspect of the invention, a driving circuit is provided which is applied to a matrix device having a plurality of functional elements arranged in a matrix, which is connected to the functional elements via data lines and which has a plurality of blocks. The driving circuit includes a shift register which has a plurality of register sections, each of the register sections being corresponding to one of the plurality of blocks; a data signal line; a first data latch circuit connected to an output terminal of the shift register and the data signal line; and a second data latch circuit connected to the output terminal of the shift register and an output terminal of the first data latch circuit, and connected to the data line directly or via another circuit. The first and second data latch circuits are respectively divided into multistage operation units. Each of the operation units is corresponding to the one data line or the plurality of data lines and is corresponding to one of the plurality of blocks. An output terminal of the shift register belonging to a block B is connected to the operation unit of the first data latch circuit belonging to the block B, the output terminal of the shift register belonging to a block A is connected to the operation unit of the second data latch circuit belonging to the block B, and each of the block A and block B is one of the plurality of blocks.

With this configuration, since the first and second data latch circuits are divided into a plurality of operation units, and the input of the signals to the data lines is performed for each operation unit, the amount of current per one operation unit is lessened to a large extent, as compared with the case where the signals are input all at once to all the data lines as in the line-sequential system of the data line driving circuit. Accordingly, a large and instantaneous peak current does not occur. Consequently, according to an aspect of the invention, it is possible to provide a driving circuit which operates stably even in a matrix device with a low-performance power supply.

Further, in an aspect of the invention, the operation unit of the first data latch circuit and the operation unit of the second data latch circuit, which belong to the same block, are connected to the different register section of the shift register respectively. In this way, the operation of the second data latch circuit is controlled by the shift register, so that the line supplying the latch activation signal is not needed, and the circuit can be formed without increasing its area.

It is preferable that the output terminal of the same shift register is connected to the operation unit of the first data latch circuit, and the operation unit of the second data latch circuit belonging to a block different from that of the operation unit of the first data latch circuit. In other words, it is preferable that the lines connected to the output terminal of the shift register are configured to be branched and connected to the operation unit of the first data latch circuit and the operation unit of the second data latch circuit. With such a configuration, it is possible to perform the signal input operation by operating simultaneously the operation unit of the first data latch circuit and the operation unit of the second data latch circuit. In addition, the number of stages of the shift register can be suppressed to a minimum, thereby leading to a favorable configuration for driving circuit miniaturization.

It is preferable that the operation unit of the second data latch circuit is disposed in a preceding block in the scanning direction of the shift register with respect to the operation unit of the first data latch circuit. According to such a configuration, it is possible, in a single scanning of the shift register, to execute the signal input to the operation unit of the first data latch circuit, and the signal transfer from the first data latch circuit to the second data latch circuit.

It is preferable that the operation unit of the second data latch circuit is disposed in a block just preceding the operation unit of the first data latch circuit. According to such a configuration, the length of the line connecting the output terminal of the shift register and the second data latch circuit can be shortened, thereby leading to a favorable configuration for driving circuit miniaturization.

It is preferable that the numbers of the data lines corresponding to each of the operation units in the first and second data latch circuits are identical to each other. With such a configuration, it is possible to make the current or power required per operation unit uniform.

Next, according to a second aspect of the invention, a matrix device including the driving circuit described above is provided. According to such a configuration, it is possible to provide a matrix device which suppresses the generation of an instantaneous peak current in the driving circuit, and stably operates even with a low-performance power supply.

According to a third aspect of the invention, an image display device having a plurality of pixels arranged in a matrix is provided. The image display device includes the driving circuit described above which is connected to the plurality of pixels via the data lines. According to such a configuration, it is possible to provide an image display device which suppresses the generation of an instantaneous peak current in the driving circuit, and stably operates even with a low-performance power supply.

According to a fourth aspect of the invention, an electrophoretic display device is provided, in which an electrophoretic element is interposed between a pair of substrates, and a plurality of pixels is arranged in a matrix. The electrophoretic display device includes the driving circuit described above which is connected to the plurality of pixels via the data lines. According to such a configuration, it is possible to provide an electrophoretic display device which suppresses the generation of an instantaneous peak current in the driving circuit, and stably operates even with a low-performance power supply.

According to a fifth aspect of the invention, an electronic apparatus is provided, which includes at least one of the matrix device, the image display device, and the electrophoretic display device described above. According to such a configuration, it is possible to provide an electronic apparatus including a display device or a capacitive detection device which suppresses the generation of an instantaneous peak current in the driving circuit, and stably operates even with a low-performance power supply.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
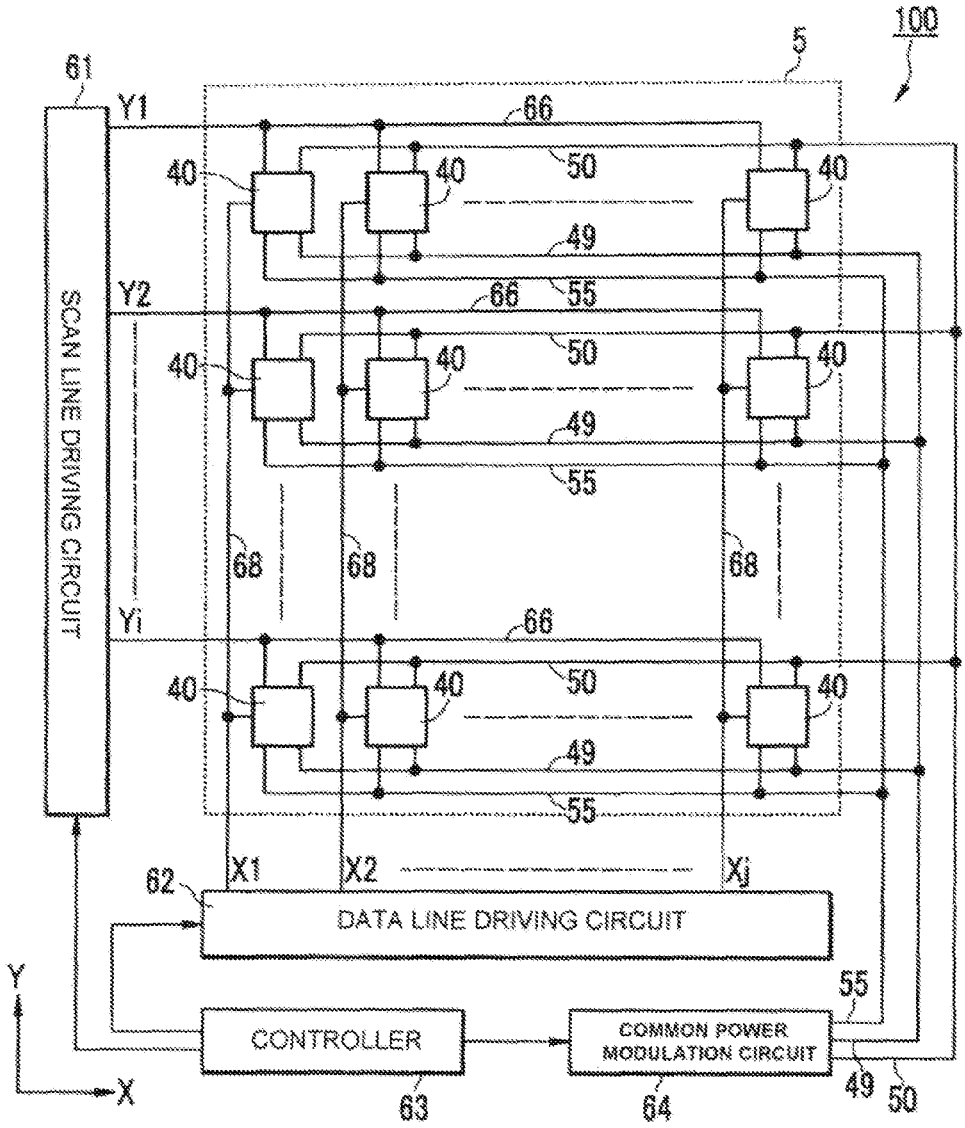
FIG. 1 is a schematic configuration diagram of the electrophoretic display device according to the embodiment.

Hereinafter, description will be given of the electrophoretic display device of an active matrix system, which is an embodiment of the matrix device according to the invention, with reference to the drawings. In addition, the exemplary embodiment described below shows an aspect of the invention, to which the invention is not limited. Therefore, the invention may be arbitrarily modified within the scope of the technical idea of the invention. Further, to aid understanding of each configuration, the scales or the numbers and the like in the real structure are different to those of each structure in the drawings described below.

FIG. 1 is a schematic configuration diagram of an electrophoretic display device 100 according to the present embodiment. The electrophoretic display device 100 includes a display section 5 in which a plurality of pixels 40 (functional element) is arranged in a matrix. A scan line driving circuit 61, a data line driving circuit 62, a controller (control section) 63, and a common power modulation circuit 64 are disposed on the periphery of the display section 5. The scan line driving circuit 61, the data line driving circuit 62, and the common power modulation circuit 64 are connected, respectively, to the controller 63. The controller 63 comprehensively controls these circuits based on image data and synchronized signals supplied from the upper apparatus.

A plurality of scan lines 66 extending from the scan line driving circuit 61, and a plurality of data lines 68 extending from the data line driving circuit 62 are formed in the display section 5. In correspondence to these intersections, the pixels 40 are disposed.

The scan line driving circuit 61, which is connected to each of the pixels 40 via i scan lines 66 (Y1, Y2, . . . , Yi), sequentially selects the scan lines 66 from the first row to the i-th row, and supplies a selection signal defining the on-timing of a selection transistor 41 (see FIG. 2) disposed in the pixels 40 via the selected scan line 66, under the control of the controller 63.

The data line driving circuit 62, which is connected to each of the pixels 40 via j data lines 68 (X1, X2, . . . , Xj), supplies an image signal defining one-bit pixel data corresponding to each of the pixels 40 to the pixels 40 under the control of the controller 63. Further, in the present embodiment, it is assumed that when defining pixel data "0", an image signal of a low level (L) is supplied to the pixels 40, and that when defining pixel data "1", an image signal of a high level (H) is supplied to the pixels 40.

Further, a low potential power line 49 extending from a common power modulation circuit 64, a high potential power line 50, and a common electrode line 55 are disposed in the display section 5. Each of the lines is connected to the pixels 40. The common power modulation circuit 64 generates various types of signals to be supplied to each of the above-described lines while electrical connecting and disconnecting each of these lines (making impedance high), under the control of the controller 63.

Figure 2:
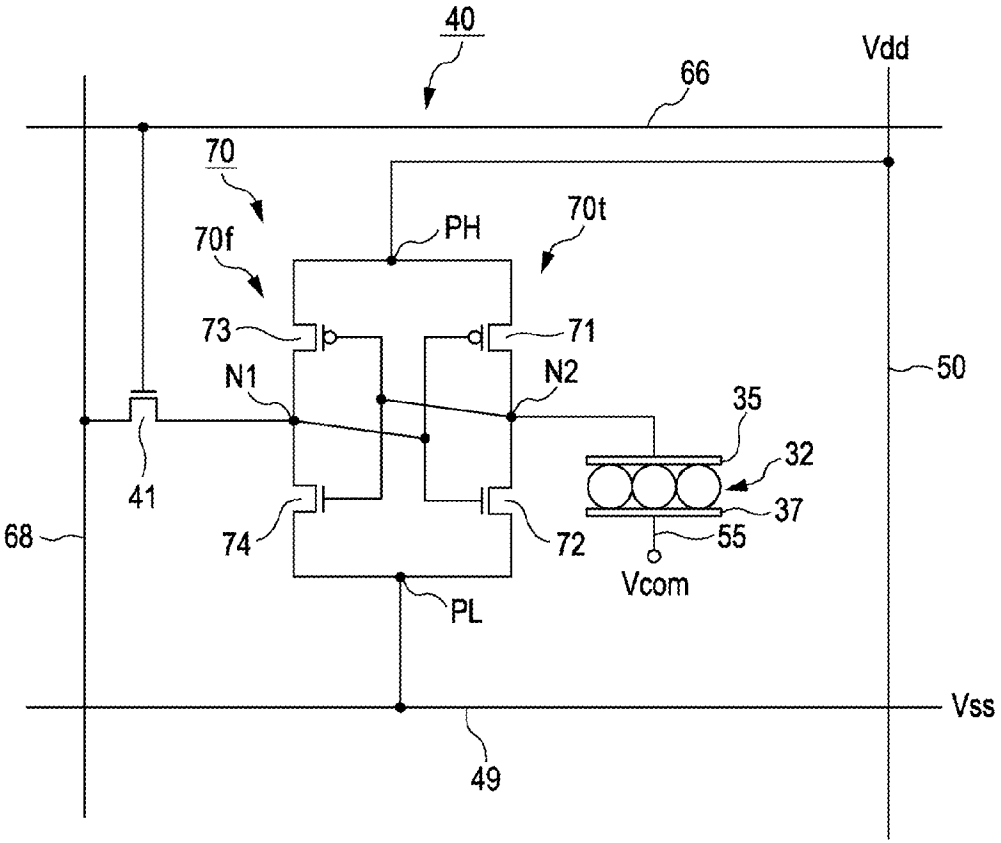
FIG. 2 is a circuit configuration diagram of the pixel.

FIG. 2 is a circuit configuration diagram of the pixels 40 disposed in the display section 5. The pixel 40 is configured to include a selection transistor 41 (pixel switching element), a latch circuit 70, an electrophoretic element 32, a pixel electrode 35 (first electrode), and a common electrode 37 (second electrode; opposite electrode). The scan line 66, the data line 68, the low potential power line 49, and the high potential power line 50 are disposed so as to encompass these elements. The pixel 40 is constituted as a SRAM (Static Random Access Memory) system in which the image signal is retained as an electric potential by the latch circuit 70.

In the selection transistor 41, which is an N-MOS (Negative Metal Oxide Semiconductor) transistor, the gate terminal thereof is connected to the scan line 66, the source terminal is connected to the data line 68, and the drain terminal is connected to the data input terminal N1 of the latch circuit 70. The data output terminal N2 of the latch circuit 70 is connected to the pixel electrode 35. An electrophoretic element 32 is interposed between the pixel electrode 35 and the common electrode 37.

The latch circuit 70 includes a transfer inverter 70*t* and a feedback inverter 70*f*. Either the transfer inverter 70*t* or the feedback inverter 70*f* is a C-MOS inverter. The transfer inverter 70*t* and the feedback inverter 70*f* make a loop structure in which the output terminal of one of them is connected to the input terminal of the other. A power supply voltage is supplied to each of the inverters from a high potential power line 50 connected via the high potential power terminal PH, and from a low potential power line 49 connected via the low potential power terminal PL.

The transfer inverter 70*t* has a P-MOS (Positive Metal Oxide Semiconductor) transistor 71 and an N-MOS transistor 72. The source terminal of the P-MOS transistor 71 is connected to the high potential power terminal PH, and the drain terminal is connected to the data output terminal N2. The source terminal of the N-MOS transistor 72 is connected to the low potential power terminal PL, and the drain terminal is connected to the data output terminal N2. The gate terminals (input terminal of the transfer inverter 70*t*) of the P-MOS transistor 71 and the N-MOS transistor 72 are connected to the data input terminal N1 (output terminal of the feedback inverter 70*f*).

The feedback inverter 70*f* has a P-MOS transistor 73 and an N-MOS transistor 74. The source terminal of the P-MOS transistor 73 is connected to the high potential power terminal PH, and the drain terminal is connected to the data input terminal N1. The source terminal of the N-MOS transistor 74 is connected to the low potential power terminal PL, and the drain terminal is connected to the data input terminal N1. The gate terminals (input terminal of the feedback inverter 70*f*) of the P-MOS transistor 73 and the N-MOS transistor 74 are connected to the data output terminal N2 (output terminal of the transfer inverter 70*t*).

If an image signal (pixel data "1") of a high level (H) is stored in the latch circuit 70 of the above-described configuration, a signal of a low level (L) is outputted from the data output terminal N2 of the latch circuit 70. On the other hand, if an image signal (pixel data "0") of a low level (L) is stored in the latch circuit 70, a signal of a high level (H) is outputted from the data output terminal N2. The electric potential outputted from the data output terminal N2 is then inputted to the pixel electrode 35. On the other hand, a common electrode electric potential Vcom is supplied to the common electrode 37 via a common electrode line 55 (FIG. 1). The electrophoretic element 32 displays an image by an electric field occurring due to the difference in the electric potentials between the pixel electrode 35 and the common electrode 37.

Figure 3A:
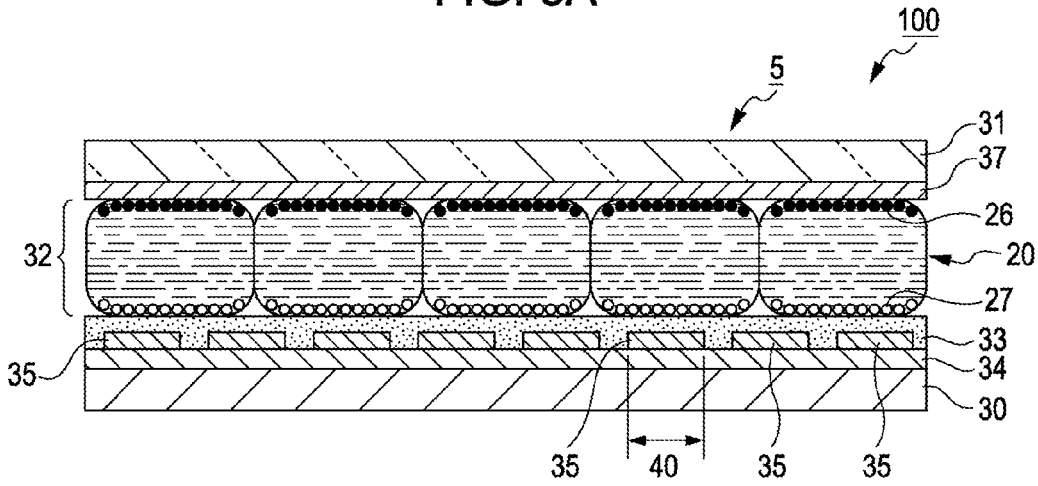
FIG. 3 is a cross sectional view of the electrophoretic display device and a microcapsule.

Next, FIG. 3A is a partial cross sectional view of the electrophoretic display device 100 in the display section 5. The electrophoretic display device 100 is constituted so that the electrophoretic element 32, in which a plurality of microcapsules 20 is arranged, is interposed between an element substrate (first substrate) 30 and an opposite substrate (second substrate) 31.

On the element substrate 30 facing the electrophoretic element 32 in the display section 5, a circuit layer 34 is disposed in which the scan line 66, the data line 68, the selection transistor 41, the latch circuit 70 or the like are formed as shown in FIG. 1 and FIG. 2. On the circuit layer 34, a plurality of pixel electrodes 35 are arranged and formed. The element substrate 30 is a substrate composed of glass, plastic or the like. The element substrate 30 may not be transparent since it is disposed on the side opposite to the image display surface. The pixel electrode 35 is an electrode which applies a voltage to the electrophoretic element 32 formed by the lamination of a nickel coating and a gold coating in this order on a Cu (copper) foil, or formed by Al (aluminum), ITO (indium/tin oxide) or the like.

On the other hand, on the opposite substrate 31 facing the electrophoretic element 32, a planar shaped common electrode 37 is formed opposite to a plurality of pixel electrodes 35. The electrophoretic element 32 is disposed on the common electrode 37. The opposite substrate 31 is a substrate composed of glass, plastic or the like. The opposite substrate 31 is a transparent substrate since it is disposed on the side of the image display. The common electrode 37 is an electrode which applies a voltage to the electrophoretic element 32 together with the pixel electrode 35. The common electrode 37 is a transparent electrode formed of MgAg (silver magnesium), ITO (indium/tin oxide), IZO (indium/zinc oxide) or the like. The element substrate 30 and the opposite substrate 31 are then bonded by adhering the electrophoretic element 32 and the pixel electrode 35 via an adhesive layer 33.

In addition, generally, the electrophoretic element 32 is formed in advance on the side of the opposite substrate 31, and handled as an electrophoretic sheet including up to the adhesive layer 33. In the manufacturing process, the electrophoretic sheet is handled in a state where a protective release sheet is attached onto the surface of the adhesive layer 33. Next, the release sheet is peeled off from the electrophoretic sheet, and the electrophoretic sheet without the release sheet is attached to the separately manufactured element substrate 30 (on which the pixel electrodes 35 and various types of circuits or the like are formed), to thereby form the display section 5. Therefore, the adhesive layer 33 exists only on the side of the pixel electrode 35.

Figure 3B:
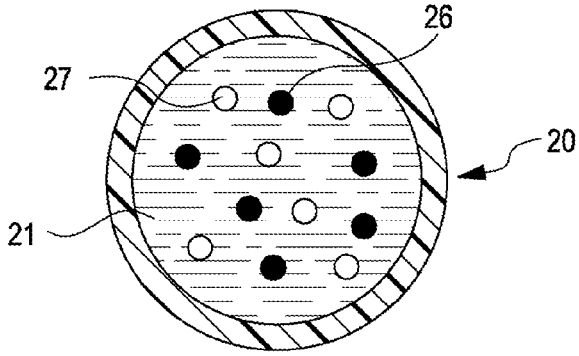

FIG. 3B is a schematic cross sectional view of the microcapsule 20. The microcapsule 20 has a particle diameter of, for example, 50 μm or so. The microcapsule 20 is a globular body in which a dispersion medium 21, a plurality of white particle (electrophoretic particle) 27, and a plurality of black particle (electrophoretic particle) 26 are sealed in the inside.

The microcapsule 20 is interposed between the common electrode 37 and the pixel electrode 35 as shown in FIG. 3. One or a plurality of microcapsules 20 is disposed within one pixel 40.

An outer casing (wall film) of the microcapsule 20 is formed using an acrylic resin such as methyl polymethacrylate and ethyl polymethacrylate, urea resin, translucent polymeric resin such as arabic gum, or the like. The dispersion medium 21 is a liquid for dispersing the white particle 27 and the black particle 26 in the microcapsule 20. The dispersion media 21 includes, for example, water, an alcoholic solvent (e.g., methanol, ethanol, isopropanol, butanol, octanol, methyl cellosolve or the like), esters (e.g., ethyl acetate, butyl acetate or the like), ketones (e.g., acetone, methylethyl ketone, methylisobutyl ketone or the like), aliphatic hydrocarbon (e.g., pentane, hexane, octane or the like), alicyclic hydrocarbon (e.g., cyclohexane, methylcyclohexane or the like), aromatic hydrocarbon (e.g., benzenes having benzene, toluene or a long-chain alkyl group (xylene, hexyl benzene, heptyl benzene, octyl benzene, nonyl benzene, decyl benzene, undecyl benzene, dodecyl benzene, tridecyl benzene, tetradecyl benzene or the like)), halogenated hydrocarbon (e.g., chloride methylene, chloroform, tetrachloride carbon, 1,2-dichloroethane or the like), calboxylic acid salt or the like, and oils other than these. These materials can be used alone or as a mixture, and further blended with a surfactant or the like.

The white particle 27 is, for example, a particle containing a white pigment such as titanium dioxide, zinc oxide and antimony trioxide (polymeric or colloid), and is used, for example, as negatively charged. The black particle 26 is, for example, a particle (polymeric or colloid) containing a black pigment such as aniline black and carbon black, and is used, for example, as positively charged. These pigments may be added with a charge-controlling agent containing particles such as an electrolyte, a surfactant, a metallic soap, a resin, a rubber, an oil, a varnish, or a compound, a dispersed agent such as a titanium-based coupling agent, an aluminum-based coupling agent, or a silane-based coupling agent, a lubricant agent, a stabilizing agent or the like, if necessary. In addition, in place of the black particle 26 and the white particle 27, for example, a pigment such as red, green and blue may be used. According to such a configuration, it is possible to display red, green, blue or the like in the display section 5.

Figure 4A:
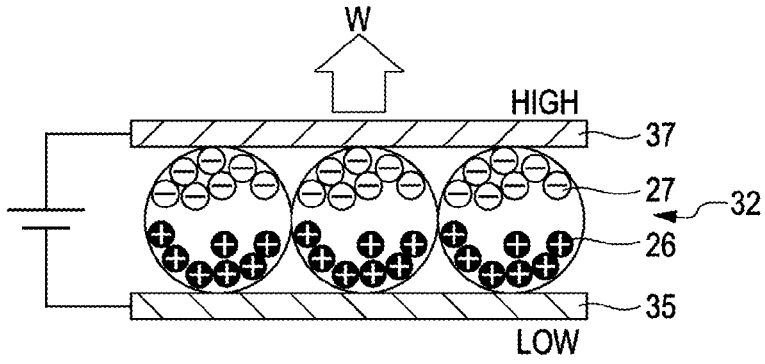
FIG. 4 is an explanatory diagram of the operation of the electrophoretic element.
Figure 4B:
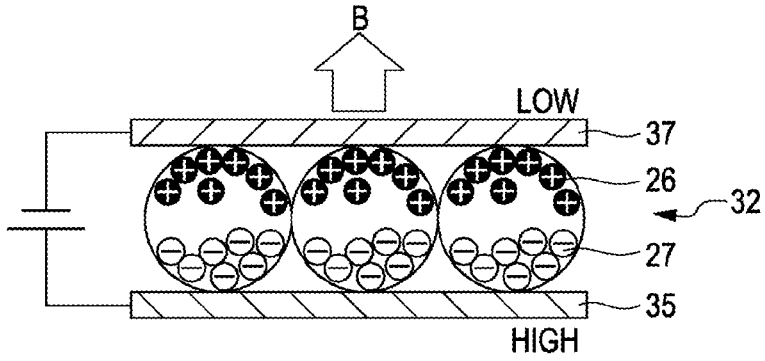

FIG. 4 is an explanatory diagram of the operation of the electrophoretic element. FIG. 4A illustrates the performance of white display in the pixel 40, and FIG. 4B illustrates the performance of the black display in the pixel 40, respectively. In the electrophoretic display device 100, an image signal inputted via the selection transistor 41 is stored in the latch circuit 70, and an electric potential outputted from the latch circuit 70, in which the image signal is maintained, is inputted to the pixel electrode 35. Herewith, a predetermined electric potential is inputted to the pixel electrode 35, and the black or white display in the pixel 40 is performed on the basis of the difference in the electric potentials between the pixel electrode 35 and the common electrode 37, as shown in FIG. 4.

In the case of white display as shown in FIG. 4A, the common electrode 37 is maintained at a relatively high potential, whereas the pixel electrode 35 is maintained at a relatively low potential. Thus, the negatively charged white particles 27 are attracted toward the common electrode 37, whereas the positively charged black particles 26 are attracted toward the pixel electrode 35. As a result, when the pixel is viewed from the common electrode 37 side, which is the display surface side, white (W) is recognized. In the case of black display as shown in FIG. 4B, the common electrode 37 is maintained at a relatively low potential, whereas the pixel electrode 35 is maintained at a relatively high potential. Thus, the positively charged black particles 26 are attracted toward the common electrode 37, whereas the negatively charged white particles 27 are attracted toward the pixel electrode 35. As a result, when the pixel is viewed from the common electrode 37 side, black (B) is recognized.

Figure 5:
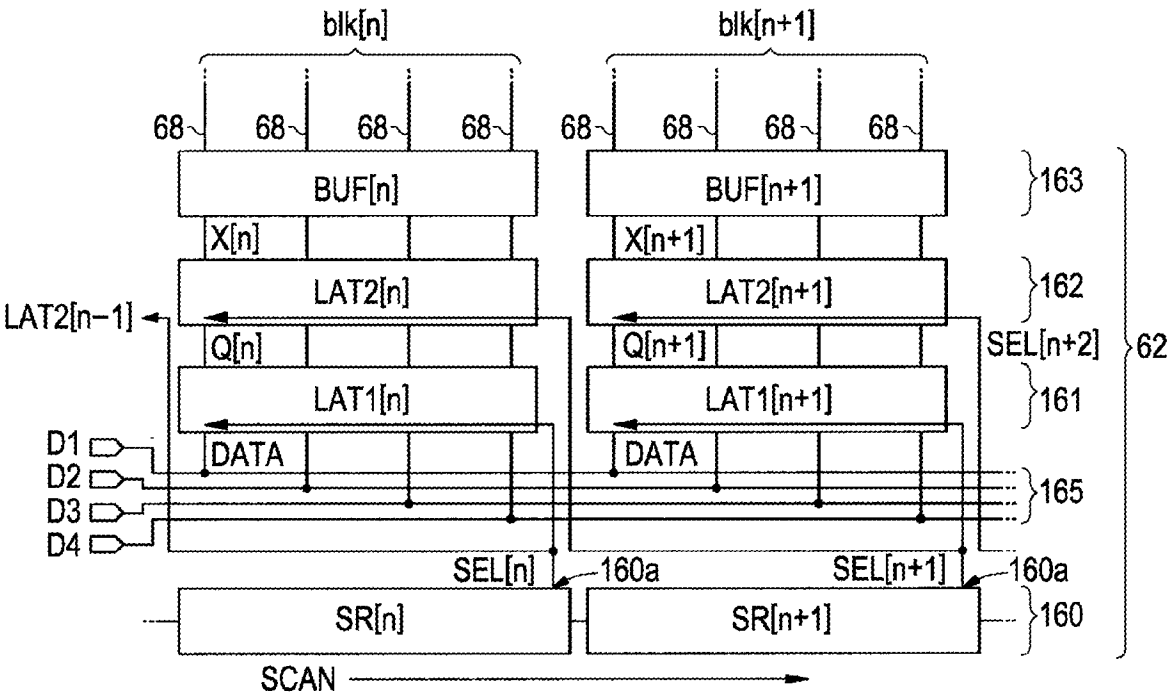
FIG. 5 is a partial configuration diagram of the data line driving circuit according to the embodiment.
Figure 6:
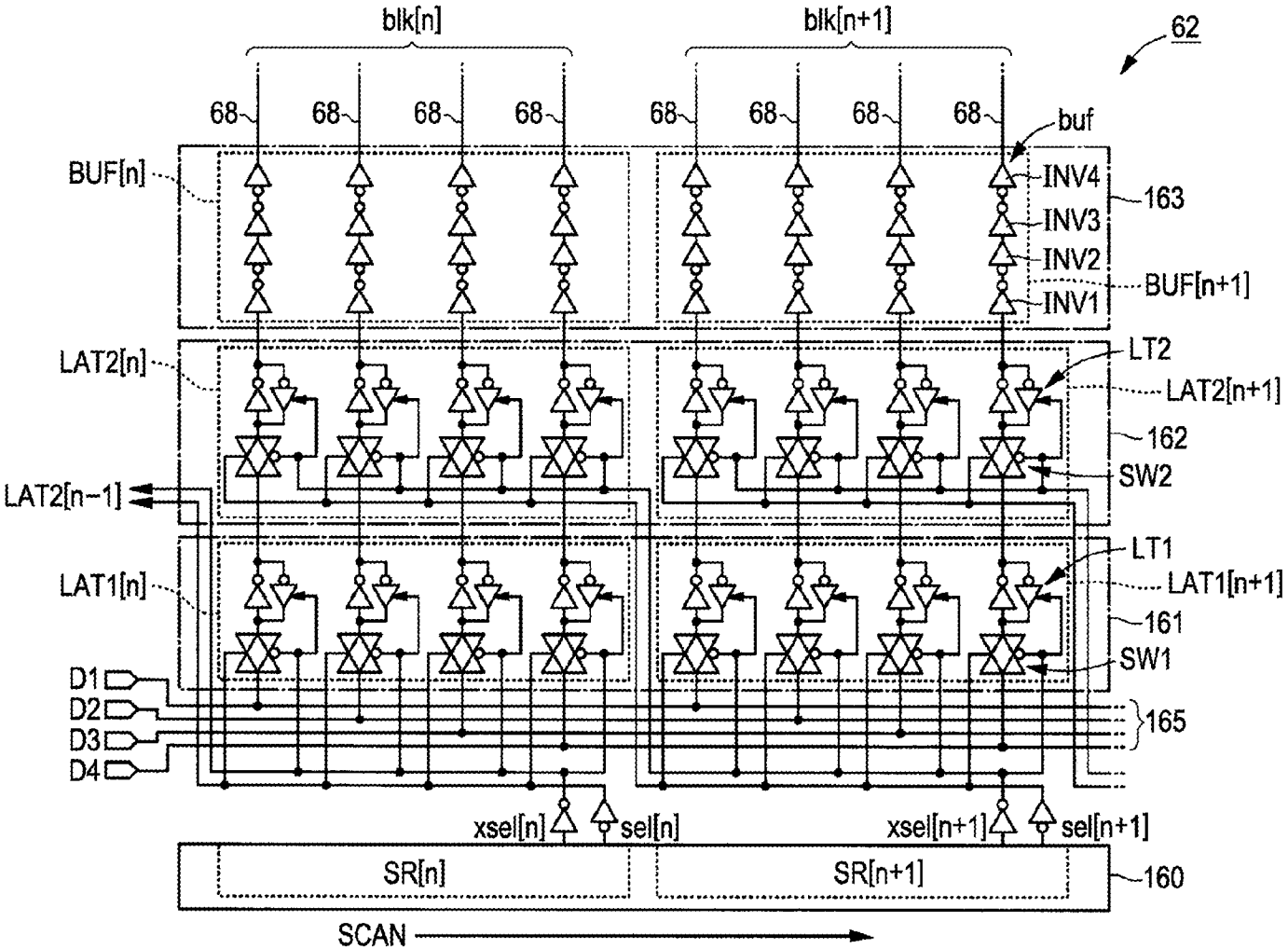
FIG. 6 is a view showing an example of the particular configuration of the data line driving circuit according to the embodiment.

Next, FIG. 5 is a partial configuration diagram showing a portion of the data line driving circuit 62 included in the electrophoretic display device 100 of the present embodiment. FIG. 6 is a view showing an example of the particular configuration of the data line driving circuit 62 as shown in FIG. 5.

As shown in FIG. 5, the data line driving circuit 62 has a shift register 160, a first data latch circuit 161, a second data latch circuit 162, and a data buffer circuit 163. In the case of the present embodiment, the data line driving circuit 62 is divided into multistage blocks blk in which one operation unit (block) is defined as a section which outputs the image signal to four data lines 68. In particular, the first data latch circuit 161 is divided into a plurality of blocks LAT1 corresponding to a plurality of blocks blk, respectively. In addition, the second data latch circuit 162 is divided into a plurality of blocks LAT2 corresponding to a plurality of blocks blk, respectively. Furthermore, the data buffer circuit 163 is divided into a plurality of blocks BUF corresponding to a plurality of blocks blk, respectively.

Further, when the data line driving circuit 62 is divided into N stages of block blk in the present specification, the arbitrary n-th stage of the block blk is marked with blk[n] (n is an integer within the range of $0 \leqq n \leqq N-1$), and symbols having a suffix [n] (SR[n], LAT1[*n*], etc.) are affixed to the components belonging to blk[n], to thereby distinguish them clearly from other components. Here, the scanning direction of the shift register is set to be a direction of increasing n. In addition, the block blk having relatively large n is also referred to as "the latter stage" of the block blk, and the block blk having relatively small n is also referred to as "the former stage" of the block blk. In the description below, the blocks may be also marked with SR[n−1], LAT1[*n*−2] or the like. However, these are symbols marked in order to be indicative of the relative position of the blocks, and the stage preceding the block blk[0] does not exist.

The shift register 160 is constituted so that the register sections SR corresponding to each block blk are dependently connected. The shift register 160 sequentially transfers the input signal to the register sections SR[0], SR[1], . . . in synchronization with a clock pulse to operate each register section SR in sequence, to thereby sequentially output the selection signal SEL from the output terminal 160*a* of the register section SR.

The output terminal of the n-th stage of the register section SR[n] of the shift register 160 is connected to the n-th stage of the block LAT1[*n*] of the first data latch circuit 161, and the (n−1)-th stage of the block LAT2[*n*−1] of the second data latch circuit 162. That is, the block LAT2[*n*−1] of the second data latch circuit 162 connected to the output terminal of a certain register section SR[n] is disposed in a preceding stage in the scanning direction of shift register 160 with respect to the block LAT1[*n*] of the first data latch circuit 161 connected to the output terminal of the register section SR[n].

A plurality of (four in the present embodiment) data signal lines 165 is connected to the block LAT1[*n*] of the first data latch circuit 161, together with the register section SR[n]. Further, the output terminal of the block LAT1[*n*] is connected to the input terminal of the n-th stage of the block LAT2[*n*] of the second data latch circuit 162.

The (n+1)-th stage of the register section SR[n+1] of the shift register 160 is connected to the block LAT2[*n*] of the second data latch circuit 162, together with the block LAT1[*n*] of the first data latch circuit 161. Further, the output terminal of the second data latch circuit 162 is connected to the input terminal of the n-th stage of the block BUF[n] of the data buffer circuit 163. The output terminal of the block BUF[n] is connected to four data lines 68.

In a specific example shown in FIG. 6, the shift register 160 has a pair of output terminals for each register section SR. The selection signal sel[n] is outputted from one output terminal (first output terminal) of the register section SR[n], and the inversion selection signal xsel[n] is outputted from the other output terminal (second output terminal). Accordingly, the selection signal SEL[n] shown in FIG. 3 is constituted by two signals of the selection signal sel[n] and the inversion selection signal xsel[n] which are synchronously outputted.

The first and second output terminals of the register section SR[n] are connected to the n-th stage of the block LAT1[*n*] of the first data latch circuit 161 corresponding to the register section SR[n], and are connected to the (n−1)-th stage of the block LAT2[*n*−1] of the second data latch circuit 162.

The first data latch circuit 161 has a plurality of latch circuits LT1 disposed to correspond to each data line 68, and a transmission gate SW1 connected to each latch circuit LT1. In the case of the present embodiment, each block LAT1 is configured to have four latch circuits LT1 and four transmission gates SW1.

In the n-th stage of the block LAT1[*n*] of the first data latch circuit 161, each input terminal of the four transmission gates SW1 is connected to the data signal lines 165 different from each other. The output terminal of each transmission gate SW1 is connected to the input terminal of the corresponding latch circuit LT1. The first output terminal (selection signal sel[n]) of the register section SR[n] is connected to the control input terminal of the transmission gate SW1, and the second output terminal (inversion selection signal xsel[n]) of the register section SR[n] is connected to the inversion control input terminal. The transmission gate SW1 is turned on and off on the basis of the selection signal sel[n] and the inversion selection signal xsel[n] inputted from the register section SR[n], and switches the status of connection between the data signal line 165 and the latch circuit LT1.

The latch circuit LT1 is configured to connect two inverters in a loop, in the configuration shown in FIG. 4. The latch circuit LT1 maintains the electric potential (image signals D1 to D4) of the data signal line 165 inputted via the transmission gate SW1. The output terminal of the latch circuit LT1 is connected to the block LAT2[*n*] of the second data latch circuit 162. In addition, the inversion selection signal xsel[n] is inputted to the latch circuit LT1 from the second output terminal of the register section SR[n], and the writing to the latch circuit LT1 is activated by the input of the inversion selection signal xsel[n].

The second data latch circuit 162 has a plurality of latch circuits LT2 disposed to correspond to each data line 68, and the transmission gate SW2 connected to the input terminal of each latch circuit LT2. In the case of the present embodiment, each block LAT2 is configured to include four latch circuits LT2 and four transmission gates SW2.

The input terminals of four transmission gates SW2 constituting the n-th stage of the block LAT2[*n*] of the second data latch circuit 162 are connected to the output terminals of the latch circuit LT1 of the corresponding block LAT1[*n*], respectively. The output terminals of the transmission gate SW1 are connected to the input terminals of the corresponding latch circuit LT2.

The first output terminal (selection signal sel[n+1]) of the (n+1)-th stage (next stage) of the register section SR[n+1] is connected to the control input terminal of each transmission gate SW2, and the second output terminal (inversion selection signal xsel[n+1]) of the register section SR[n+1] is connected to the inversion control input terminal. The transmission gate SW2 belonging to the n-th stage of the block LAT2[*n*] switches the status of connection between the latch circuit LT1 and the latch circuit LT2, on the basis of the selection signal sel[n+1] and the inversion selection signal xsel[n+1] which are inputted from the (n+1)-th stage of the register section SR[n+1].

The latch circuit LT2 is configured to connect two inverters in a loop, in the configuration shown in FIG. 4. The latch circuit LT2 maintains the output potential of the latch circuit LT1 inputted via the transmission gate SW2. The output terminal of the latch circuit LT2 is connected to the n-th stage of the block BUF[n] of the data buffer circuit 163. In addition, the inversion selection signal xsel[n+1] is inputted to the latch circuit LT2 from the second output terminal of the (n+1)-th stage of the register section SR[n+1], and the writing to the latch circuit LT2 is activated by the input of the inversion selection signal xsel[n+1].

The data buffer circuit 163 is composed of a plurality of blocks BUF having buffers buf disposed in correspondence to each data line 68. In the case of the present embodiment, each block BUF is configured to include four buffers buf. Further, each buffer buf has inverters INV1 to INV4 dependently connected to the corresponding data line 68. The input terminals of four buffers buf belonging to the n-th stage of the block BUF[n] are connected to the output terminals of the corresponding latch circuit LT2 of the block LAT2[*n*] belonging to the same stage, respectively.

In the data line driving circuit 62 including the above-mentioned configuration, the selection signal SEL[n] and xsel[n]) is outputted from the first and second output terminal of the register section SR[n] of the shift register 160. Then, the four transmission gates SW1 belonging to the block LAT1[*n*] of the first data latch circuit 161 are placed in an on-state, and the writing to the four latch circuits LT1 is activated. Herewith, the four latch circuits LT1 and the data signal lines 165 corresponding to them are connected, and the image signals D1 to D4 are inputted from the data signal lines 165 to the latch circuit LT1.

In addition, at this point in time, in the block LAT2[*n*] of the second data latch circuit 162 belonging to the same block blk[n] the transmission gate SW2 is in off-state. Accordingly, the output potential of the latch circuit LT1 of the block LAT1[*n*] is not transferred to the block LAT2[*n*] of the second data latch circuit 162.

After that, the register section SR[n] is placed in a non-operating state by the shift operation of the shift register 160. If the next stage of the register section SR[n+1] is shifted to an operating state, the selection signal SEL[n+1] (sel[n+1] and xsel[n+1]) is outputted from the first and second output terminal of the register section SR[n+1]. This selection signal SEL[n+1] is inputted to the (n+1)-th stage of the block LAT1[*n*+1] of the first data latch circuit 161, and the n-th stage of the block LAT2[*n*] of the second data latch circuit 162.

In the n-th stage of the block LAT2[*n*] of the second data latch circuit 162, the transmission gate SW2 is placed in an on-state by the selection signal SEL[n+1], and the writing to the four latch circuits LT2 is activated. Herewith, the four latch circuits LT1 of the block LAT1[*n*] are connected to the four latch circuits LT2, respectively. The image signals D1 to D4 which are maintained by the latch circuit LT1 are transferred to the corresponding latch circuit LT2 of the second data latch circuit 162.

The latch circuit LT2 of the block LAT2[*n*] outputs the maintained image signals D1 to D4 to the corresponding buffer buf of the data buffer circuit 163. The image signals D1 to D4 current-amplified by the buffer buf are inputted to the corresponding data line 68. Herewith, the image signals are inputted to the four pixels 40 of the display section 5 corresponding to the block blk[n].

Furthermore, in parallel with transferring the image signals from the block LAT1[*n*] of the first data latch circuit 161 to the block LAT2[*n*] of the second data latch circuit 162, in the (n+1)-th stage of the block LAT1[*n*+1] of the first data latch circuit 161, the image signals D1 to D4 are written from the data signal line 165 to the latch circuit LT1. In other words, in the data line driving circuit 62 of the present embodiment, the image signal input to the n-th stage of the block LAT1[*n*] of the first data latch circuit 161, and the image signal input to the (n−1)-th stage of the block LAT2[*n*−1] of the second data latch circuit 162 (the image signal output to the data line 68), are executed in association with the operation of the n-th stage of the register section SR[n].

In the configuration of the present embodiment, when the first and second data latch circuit 161, 162, and the data buffer circuit 163 are divided into N stages, the shift register 160 is configured to include (N+1) stages of the register section SR. This is because one stage of the register section SR[N] is further required for the latter stage of the register section SR[N−1], in order to transfer the image signals to the final stage of the block LAT2[N−1] of the second data latch circuit 162.

According to the electrophoretic display device 100 of the present embodiment including the above-mentioned configuration, it is possible to avoid the generation of the instantaneous peak current by including the data line driving circuit 62 with the configuration as shown in FIG. 5 and FIG. 6. In the data line driving circuit 62 of the present embodiment, the first and second data latch circuits 161, 162, and the data buffer circuit 163 are divided into blocks each with a plurality of (four) data lines 68, and the writing of the image signals to data line 68 for each block is achieved. Herewith, the current amount of the data buffer circuit 163 per block is lessened to a large extent, as compared with the case where the image signals are transmitted all at once to all the data lines 68 as in the line-sequential system of the data line driving circuit, and a large and instantaneous peak current does not occur.

Figure 12:
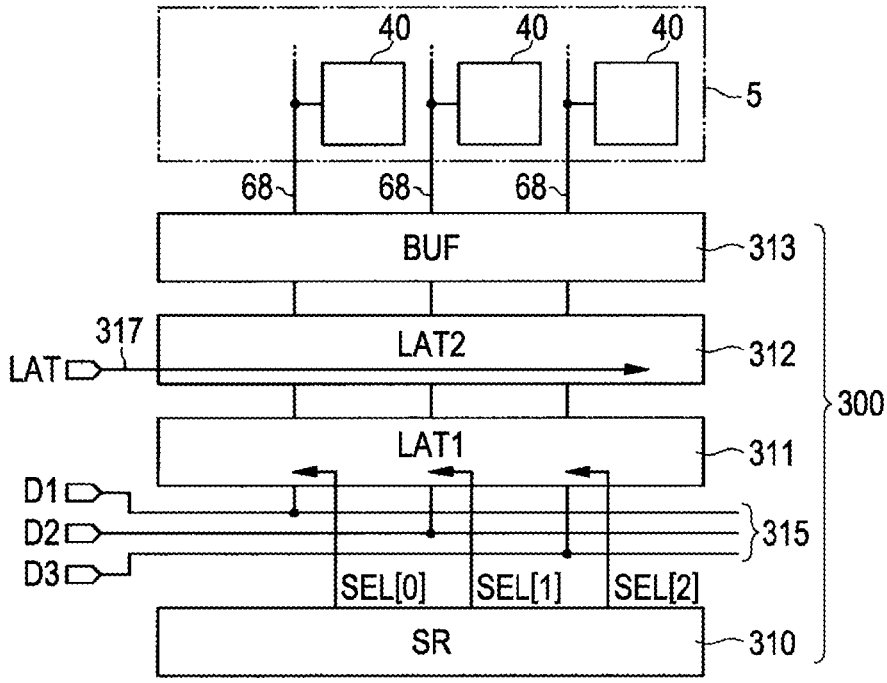
FIG. 12 is a schematic configuration diagram of the line-sequential system of the data line driving circuit.

In addition, the data line driving circuit 62 according to the present embodiment is configured to transfer the image signals to the n-th stage of the block LAT2[*n*] of the second data latch circuit 162 on the basis of the selection signal SEL[n+1] outputted from the (n+1)-th stage of the register section SR[n+1] of the shift register 160. In this way, the operation of the second data latch circuit 162 divided into the multistage is controlled by the shift register 160, so that the line (the latch control line 317 shown in FIG. 12) which supplies the signal activating the latch circuit LT2 of the second data latch circuit 162 need not be formed separately, and the data line driving circuit 62 can be formed without increasing the circuit area.

In addition, the block LAT1[*n*] of the first data latch circuit 161 and the block LAT2[*n*−1] of the second data latch circuit 162, which are activated by the selection signal SEL[n] outputted from the register section SR[n], belong to the blocks blk[n] and blk[n−1] different from each other, respectively. Therefore, the data signal line 165 and the data line 68 are not directly connected in operation. That is to say, when the image signals are supplied from the data signal line 165 to the first data latch circuit 161, the parasitic capacitance of the data line 68 need not be charged, thereby resulting in lower power consumption in the data signal line 165.

The fact that a large amount of current is not needed in the above-described data signal line 165 is an advantage of the driving circuit according to the embodiment of the invention over the dot-sequential system of the data line driving circuit. Hereinafter, in this regard, description will be given of the driving circuit according to the embodiment of the invention and the dot-sequential system of the driving circuit, comparing them with each other.

Figure 7:
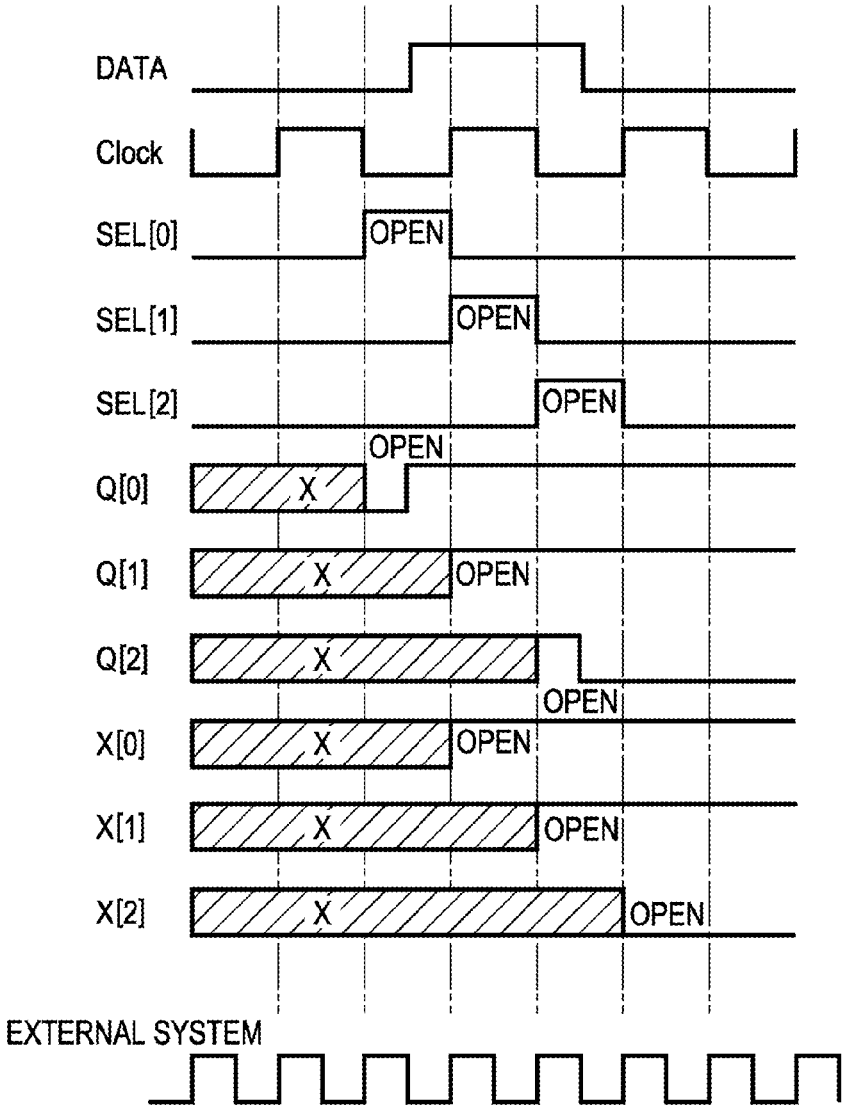
FIG. 7 is a view showing an example of timing charts according to the embodiment.
Figure 13:
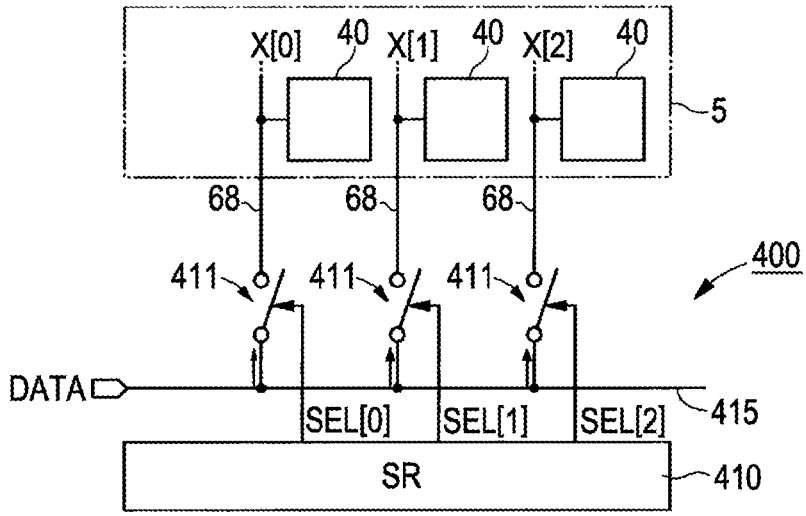
FIG. 13 is a schematic configuration diagram of the dot-sequential system of the data line driving circuit.
Figure 14:
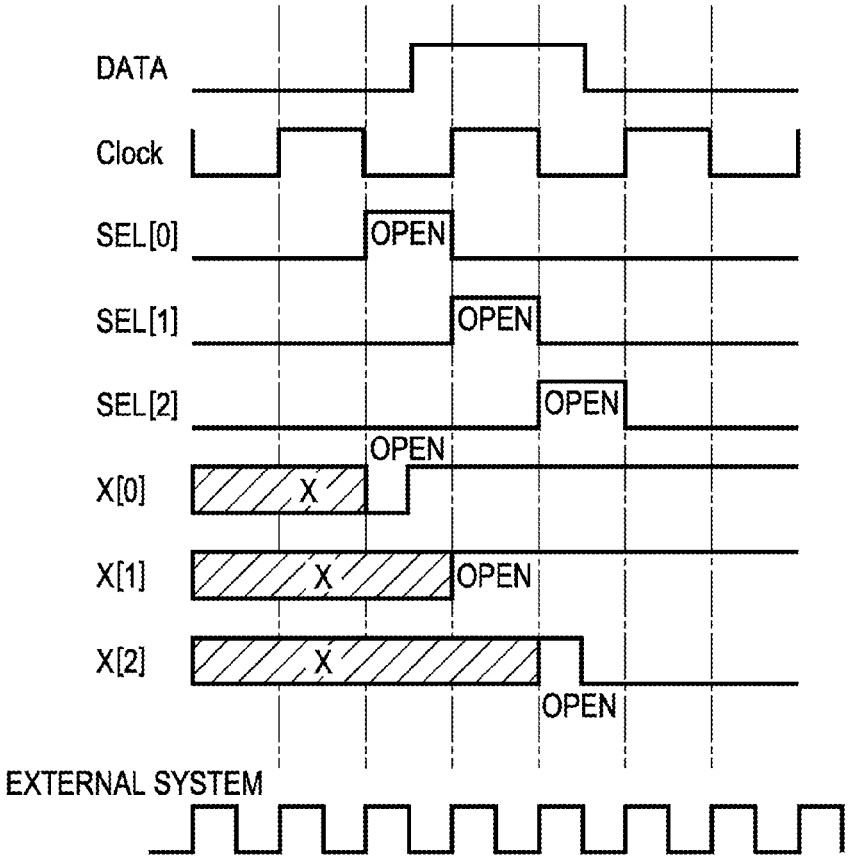
FIG. 14 is a view showing timing charts for the dot-sequential system of the data line driving circuit.
Figure 15:
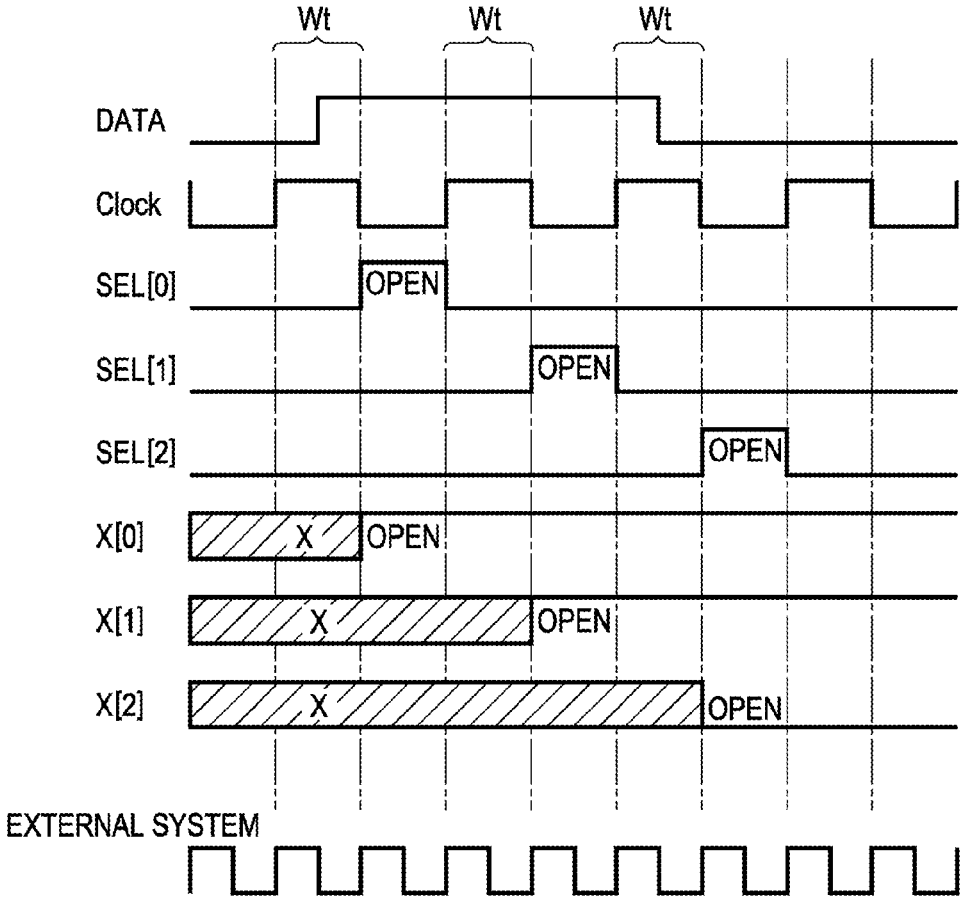
FIG. 15 is a view showing timing charts for the dot-sequential system of the data line driving circuit.

FIG. 7 is a view showing an example of the timing chart of the data line driving circuit 62 according to the embodiment of the invention. FIG. 13 is a schematic configuration diagram showing the dot-sequential system of the data line driving circuit. FIG. 14 and FIG. 15 are timing charts for two kinds of driving method of the dot-sequential system of the data line driving circuit. In the timing charts of FIG. 7, FIG. 14 and FIG. 15, the periods to which patterns are affixed together with a symbol X are indicative of the state where the corresponding line is electrically disconnected (high impedance state).

In FIG. 7, "Clock" is a clock of the shift register 160, and "SEL[n]" is a selection signal outputted from the n-th stage of the register section SR[n]. As shown in FIG. 5, "Q[n]" is an electric potential of the output terminal of the latch circuit LT1 inputting the image signal D1, among a plurality of the latch circuits LT1 belonging to the n-th stage of block LAT1[*n*] of the first data latch circuit 161. In addition, "X[n]" is an electric potential of the output terminal of the latch circuit LT2 transferring the image signal D1 from the block LAT1[*n*], among a plurality of the latch circuits LT2 belonging to the n-th stage of the block LAT2[*n*] of the second data latch circuit 162.

First, the data line driving circuit 400 of the dot-sequential system as shown in FIG. 13 is constituted so that it sequentially drives the switching elements 411 disposed between the data line 68 and the data signal line 415 by the selection signals SEL[0] to SEL[2] sequentially outputted from the shift register 410, and inputs the image signal DATA supplied via the data signal line 415 to the data line 68.

In the timing chart of FIG. 14, the above-described operation with respect to three data lines 68 is shown with the Clock of the shift register 410, and a clock of the external system. In FIG. 14, "Clock" is a clock of the shift register 410, and "SEL[n]" is a selection signal outputted from the n-th stage of the register section of the shift register 410. In addition, "X[n]" is an electric potential of the data line 68 connected to the data signal line 415 by the selection signal SEL[n].

With the driving method shown in FIG. 14, the shift register 310 outputs the selection signals SEL[0] to SEL[2] sequentially and continuously as synchronized to rising and falling of the Clock. Therefore, when the high level image signal DATA is supplied to the data line 68 (X[0]), the shift register 310 transits the electric potential of the data signal line 415 (DATA) from the low level to the high level in the output period of the selection signal SEL[0]. On the other hand, when the low level image signal DATA is supplied to the data line 68 (X[2]), the shift register 310 transitions the electric potential of the data signal line 415 (DATA) from the high level to the low level in the output period of the selection signal SEL[2].

Therefore, the electric potential X[0] of the data line 68 inputting the high level image signal DATA falls once to the low level in the period connected to the data signal line 165, and then transitions to the high level. In addition, the electric potential X[2] of the data line 68 inputting the low level image signal DATA rises once to the high level in the period connected to the data signal line 165, and then transitions to the low level.

Thus, with the data line 68 inputting the image signals at the timing when the electric potential of the image signal DATA changes (X[0], X[2]), the electric potential changes by the maximum amount in the period connected to the data signal line 415. Therefore, the data signal line 165 charges the maximum parasitic capacitance of the data line 68 while performing image signal input, thereby increasing the power consumption. Particularly, when the high level and the low level of the image signal are alternatively inputted with respect to the arranged data line 68, the data signal line 165 charges the maximum parasitic capacitance in all the data lines 68 while performing the image signal input, whereby the power consumption increases to a large extent.

The above-described problem of the power consumption can be solved, for example, by adopting the driving method showing the timing chart in FIG. 15. In the driving method as shown in FIG. 15, the data signal line 415 and the data line 68 are not connected in the period when the electric potential (DATA) of the data signal line 415 transitions. Thus, it is constituted so that the shift register 410 is synchronized only to the falling of the Clock, to output the selection signal SEL[n]. Then, the period from the rising of the Clock, to the falling is assumed to be the non-operation period (Wt) of the shift register 410. During the non-operation period Wt, the electric potential (DATA) of the data signal line 415 is transitioned. Therefore, since the electric potential of the data signal line 415 is constant in the period when the data line 68 and the data signal line 415 are connected, the parasitic capacitance to be charged does not necessarily become the maximum parasitic capacitance. Accordingly, the above-described problem of the power consumption can be resolved.

However, with the driving method as shown in FIG. 15, the non-operation period Wt needs to be established, and thus, if the Clock of the shift register 410 has a constant frequency, double writing time is required with the driving method of FIG. 14. On the other hand, if the Clock of the shift register 410 is doubled when adopting the driving method as shown in FIG. 15, it is possible to finish the writing in the time equal to that of the driving method of FIG. 14. However, at this time, the writing time for each data line 68 is halved. In addition, a stage is required for adjusting the output timing of the selection signal SEL to the shift register 410, and the circuit scale of the shift register 410 is doubled.

On the other hand, with the data line driving circuit 62 according to the present embodiment, the selection signals SEL[0] to SEL[2] from the shift register 160 are outputted sequentially and continuously as shown in FIG. 7. Therefore, the voltage of the data signal line 165 (DATA) transitions to the output period of the selection signals SEL[0] and SEL[2] similarly to the driving method of the dot-sequential system shown in FIG. 14.

However, with the data line driving circuit 62, image signal input of the block LAT1[*n*] to the latch circuit LT1 is performed in the period when the selection signal SEL[n] is outputted from the shift register 160, whereas the image signal transfer is not performed from the latch circuit LT1 of the block LAT1[*n*] to the latch circuit LT2 of the block LAT2[*n*]. Therefore, in the output period of the selection signal SEL[0], the electric potential Q[0] of the output terminal of the latch circuit LT1 transitions from the low level to the high level, whereas the electric potential X[0] of the output terminal of the corresponding latch circuit LT2 does not change. In addition, in the output period of the selection signal SEL[2], the electric potential Q[2] of the output terminal of the latch circuit LT1 changes, whereas the electric potential X[2] of the output terminal of corresponding latch circuit LT2 does not change.

Then, when the latch circuit LT2 is activated by the selection signal SEL of the next stage, and the image signal is outputted to the data line 68 from the latch circuit LT2, the electric potentials X[0] to X[2] of the output terminal of the latch circuit is constant, whereby the parasitic capacitance of the data line 68 to be charged does not necessarily become the maximum parasitic capacitance. Accordingly, with the data line driving circuit 62 of the present embodiment, it is possible to output the selection signal SEL sequentially and continuously from the shift register 160 while suppressing the increase of the power consumption involved in the parasitic capacitance charge of the data line 68. In this way, the data line driving circuit 62 of the present embodiment achieves favorable effects with respect to the data line driving circuit of the dot-sequential system in which the driving method of any of FIG. 14 and FIG. 15 is adopted.

In addition, the invention is not limited to the above-described exemplary embodiments, but may be variously constituted within the gist of the invention. For example, with the data line driving circuit 62 shown in FIG. 3, the blocks blk (the blocks LAT1, LAT2, BUF) are setup to correspond to the four data lines 68, the number of the data line 68 corresponding to the blocks blk can be arbitrarily setup. For example, the block blk may be setup per eight data lines 68, or the block blk may be setup per one or two data lines 68. However, if the number of the data lines 68 per block is small, the input period of the image signal for each data line 68 becomes short, and if the number of the data lines 68 is large, it becomes necessary to increase the buffer disposed in the output terminal of the shift register 160.

Furthermore, the number of the data lines 68 corresponding to the operation units may be different between the operation units. For example, an operation unit corresponding to two data lines 68 and an operation unit corresponding to four data lines 68 may exist together in one data line driving circuit 62.

Figure 8A:
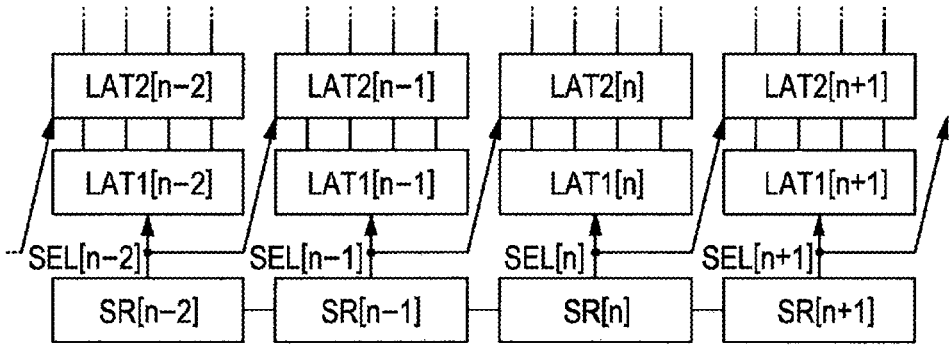
FIG. 8 is a view showing modifications of the electrophoretic display device according to the embodiment.
Figure 8B:
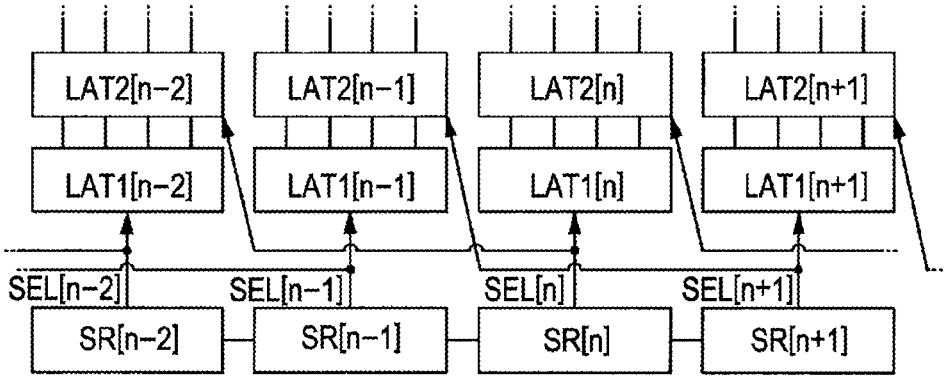

In addition, the above embodiments are constituted so that the selection signal SEL[n] outputted from the n-th stage of the register section SR[n] is inputted to the n-th stage of the block LAT1[*n*] of the first data latch circuit 161 and the (n−1)-th stage of the block LAT2[*n*−1] of the second data latch circuit 162. However, it may be constituted so that the selection signal[n] is inputted to a different stage of the block LAT2 of the second data latch circuit 162. For example, as shown in FIG. 8A, it may be constituted so that the selection signal SEL[n] is inputted to the (n+1)-th stage of the block LAT2[*n*+1] of the second data latch circuit 162. Alternatively, as shown in FIG. 8B, it may be constituted so that the selection signal SEL[n] is inputted to the (n−2)-th stage of the block LAT2[*n*−2]. In the constitution of FIG. 8B among the above, the switch of activating LAT1[*n*] and LAT2[*n*] belonging to the same block blk[n] is not in the on-state at the same time even if the circuit operation is delayed due to the voltage decrease or the like. Therefore, it is possible to realize low voltage operation with more certainty.

Figure 8C:
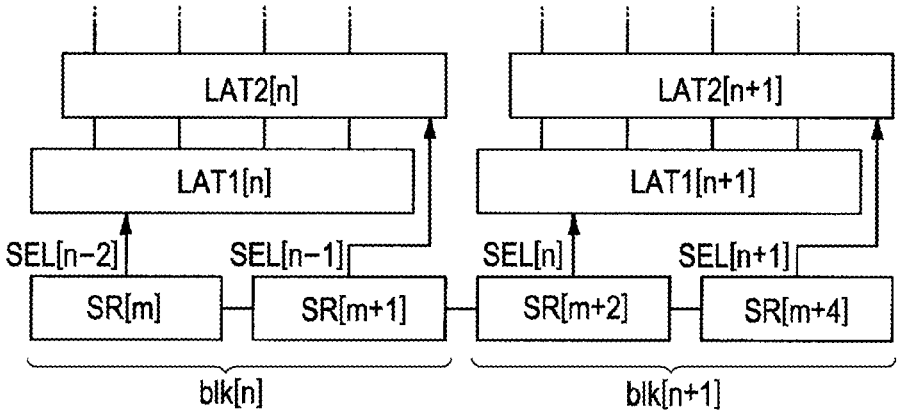

In addition, with the above embodiment, it is constituted so that the output of one register section SR[n] is branched, and the selection signal SEL[n] is outputted to the block LAT1[*n*] of the first data latch circuit 161 and the block LAT2[*n*−1] of the second data latch circuit 162. However, it may be constituted so that the output of the register section SR[n] is not branched. For example, as shown in FIG. 8C, it may be constituted so that two register sections SR[m] and SR[m+1] (m=2n) are assigned per one block blk[n], the selection signal SEL[m] outputted from the register section SR[m] is inputted to the block LAT1[*n*] of the first data latch circuit 161, and the selection signal SEL[m+1] outputted from the next stage of register section SR[m+1] is inputted to the block LAT2[*n*] of the second data latch circuit 162.

Furthermore, in the above embodiment, description has been given of the case where the constitution of the driving circuit of the invention is adopted by the data line driving circuit 62. However, the constitution of the driving circuit of the embodiment of the invention may be adopted by the scan line driving circuit 61.

In addition, in each of above-described embodiments, description has been given of the electrophoretic display device as an example of a matrix device, in which the pixels including the electrophoretic elements are adopted as functional elements. However, the matrix device according to the embodiment of the invention is not limited to the electrophoretic display device, but may be constituted as an image display device such as a liquid crystal display and an organic EL display device, a capacitance detection device, or the like.

Electronic Apparatus

Figure 9:
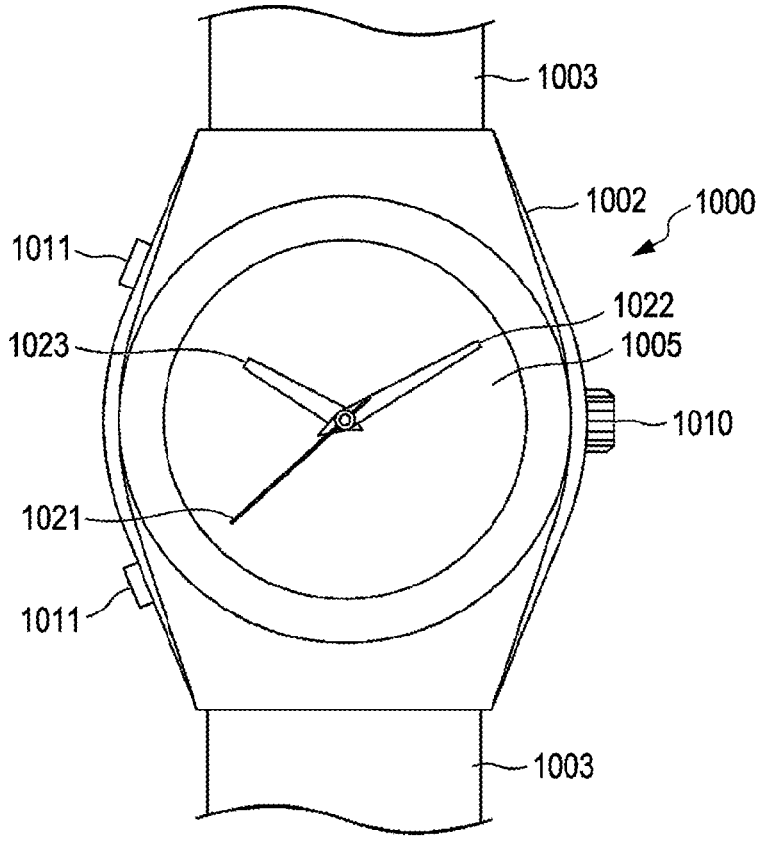
FIG. 9 is a view showing an example of the electronic apparatus.

Next, description will be given of a case where the electrophoretic display device 100 of the above-described embodiment is applied to an electronic apparatus. FIG. 9 is an elevated view of a wrist watch 1000. The wrist watch 1000 includes a clock case 1002 and a pair of bands 1003 coupled to the clock case 1002. On the front of the clock case 1002 are disposed a display section 1005 including the electrophoretic display device 100 of the above-described embodiment, a second hand 1021, a minute hand 1022 and a hour hand 1023. On the side of the clock case 1002 are disposed a winder 1010 and an operation button 1011 as manipulators. The winder 1010 is coupled to a winding stem (not shown) provided in the inside of the case, and is disposed to be capable of pushing/drawing and rotating in multistep (for example, two steps) as integrated with the winding stem. In the display section 1005, it is possible to display an image of the background, a character string such as the date and the time, or the second hand, the minute hand, the hour hand or the like.

Figure 10:
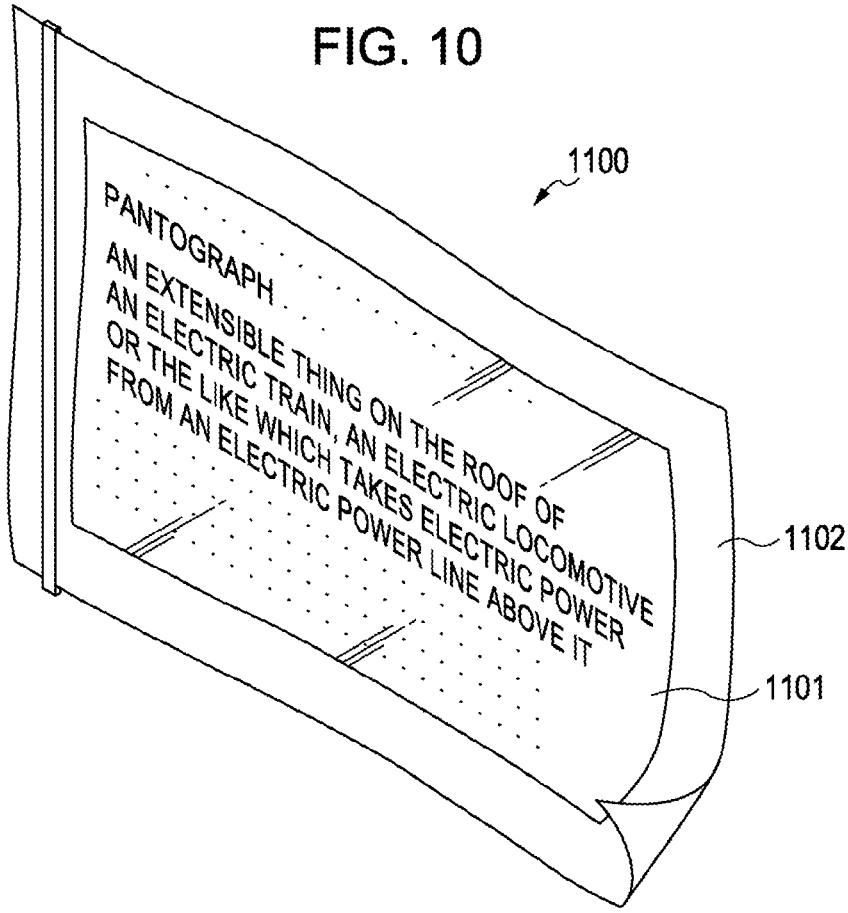
FIG. 10 is a view showing an example of the electronic apparatus.

FIG. 10 is a perspective view showing the constitution of an electronic paper 1100. The electronic paper 1100 includes the electrophoretic display device 100 of the above-described embodiment in the display region 1101. The electronic paper 1100 is constituted so that it has flexibility, and includes a main body 1102 composed of a writable sheet having the same texture and flexibility as that of existing paper.

Figure 11:
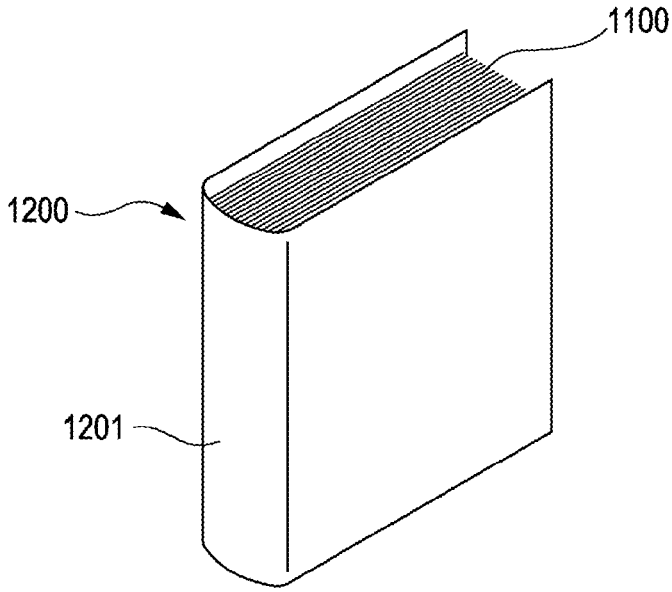
FIG. 11 is a view showing an example of the electronic apparatus.

FIG. 11 is a perspective view showing the constitution of an electronic note 1200. The electronic note 1200 bundles a plurality of above-described electronic papers 1100, and is inserted into a cover 1201. The cover 1201 includes a display data input unit not shown inputting display data which is sent, for example, from an outer apparatus. By this, depending on this display data, it is possible to change and update the display content while the electronic papers are bundled.

According to the wrist watch 1000, the electronic paper 1100 and electronic note 1200 described above, the electrophoretic display device 100 according to the embodiments of the invention is adopted, and thus include a display section stably operating even with a low-performance power supply, thereby becoming an electronic apparatus that is excellent in thrifty power consumption. In addition, the above-described electronic apparatus is an example of the electronic apparatus according to the invention, and does not limit the technical scope of the invention. For example, the electrophoretic display device according to the embodiment of the invention may be suitably used in the display section of an electronic apparatus such as a mobile telephone and a portable audio apparatus.

The entire disclosure of Japanese Patent Application No. 2008-253422, filed Sep. 30, 2008 is expressly incorporated by reference herein.

What is claimed is:

1. A driving circuit of a matrix device, which is applied to the matrix device having a plurality of functional elements arranged in a matrix, which is connected to the functional elements via data lines, and which has a plurality of blocks, comprising:

a shift register which has a plurality of register sections, each of the register sections being corresponding to one of the plurality of blocks;

a data signal line;

a first data latch circuit connected to an output terminal of the shift register and the data signal line; and a second data latch circuit connected to the output terminal of the shift register and an output terminal of the first data latch circuit, and connected to the data line directly or via another circuit, wherein the first and second data latch circuits are respectively divided into multistage operation units, each of the operation units being corresponding to the one data line or the plurality of data lines and being corresponding to one of the plurality of blocks, and wherein a first output terminal outputting from the shift register section corresponding to a block B is connected to transfer a signal to the operation unit of the first data latch circuit corresponding to the block B, a second, distinct output terminal outputting from the shift register section corresponding to a block A is directly connected to transfer a signal to the operation unit of the second data latch circuit corresponding to the block B, and each of the block A and block B is one of the plurality of blocks.

2. The driving circuit of the matrix device according to claim 1, wherein the second output terminal is connected to the operation unit of the first data latch circuit corresponding to the block A and further connected to the operation unit of the second data latch circuit corresponding to the block B.

3. The driving circuit of the matrix device according to claim 2, wherein the block B is a preceding stage in the scanning direction of the shift register with respect to the block A.

4. The driving circuit of the matrix device according to claim 3, wherein the block B is adjacent to the block A.

5. The driving circuit of the matrix device according to claim 1, wherein the numbers of the data lines corresponding to each of the operation units in the first and second data latch circuits are identical to each other.

6. A matrix device comprising the driving circuit according to claim 1.

7. An image display device having a plurality of pixels arranged in a matrix, comprising:

the driving circuit according to claim 1 which is connected to the plurality of pixels via the data lines.

8. An electrophoretic display device in which an electrophoretic element is interposed between a pair of substrates, and a plurality of pixels is arranged in a matrix, comprising:

the driving circuit according to claim 1 which is connected to the plurality of pixels via the data lines.

9. An electronic apparatus comprising at least one of the matrix device according to claim 6, the image display device according to claim 7, and the electrophoretic display device according to claim 8.

* * * * *